US007195509B2

(12) United States Patent
Hong et al.

(10) Patent No.: US 7,195,509 B2
(45) Date of Patent: Mar. 27, 2007

(54) CONNECTOR ASSEMBLY STRUCTURE OF A TERMINAL

(75) Inventors: Alex Hong, Kaohsiung (TW); Chia Ching Tsai, Kaohsiung (TW)

(73) Assignee: Sunonwealth Electric Machine Industry Co., Ltd. (TW)

( * ) Notice: Subject to any disclaimer, the term of this patent is extended or adjusted under 35 U.S.C. 154(b) by 0 days.

(21) Appl. No.: 11/222,752

(22) Filed: Sep. 12, 2005

(65) Prior Publication Data

US 2006/0160398 A1 Jul. 20, 2006

(30) Foreign Application Priority Data

Jan. 17, 2005 (TW) ..... 94101317 A

(51) Int. Cl.
*H01R 13/627* (2006.01)

(52) U.S. Cl. ..... 439/352

(58) Field of Classification Search ..... 439/350–353
See application file for complete search history.

(56) References Cited

U.S. PATENT DOCUMENTS 5,277,627 A * 1/1994 Matsuzaki ..... 439/677
6,315,590 B1 * 11/2001 Grois et al. ..... 439/248
6,383,003 B1 * 5/2002 Corona ..... 439/278

* cited by examiner

*Primary Examiner*—Truc Nguyen
(74) *Attorney, Agent, or Firm*—Bacon & Thomas PLLC

(57) ABSTRACT

The present invention relates to a connector assembly structure of a terminal used for converting connecting wires, comprising a first connector and a second connector disposed on a frame of a cooling system. The first connector is connected to the connecting wires that are connected to a stator of a motor, and is affixed on the frame. The second connector is connected to the connecting wires to be converted. The second connector has at least one hook on the periphery thereof. The cooling system has a releasing hole that corresponds to the hook and can be engaged with the hook. As a result, the second connector is secured at a fix position, and has an advantage of being detached fast by utilizing the releasing hole. Thus, this invention can satisfy the requirement of converting various connecting wires fast and easily.

8 Claims, 6 Drawing Sheets

CONNECTOR ASSEMBLY STRUCTURE OF A TERMINAL

FIELD OF THE INVENTION

The present invention is related to a connector assembly structure of a terminal used for converting connecting wires, which is applied to the converting terminals of various cooling system, and can achieve the requirement of converting various connecting wires by the design of the terminal structure of the standard connectors.

DESCRIPTION OF THE RELATED ART

The diameters of the connecting wires of the cooling systems vary with the electrical resistance of the connecting wires. For example, a connecting wire with a specification of UL 1015 18 AWG corresponds to a diameter of 2.80 mm, and a connecting wire with a specification of UL 1015 22 AWG corresponds to a diameter of 2.40 mm. However, it is consuming that the frames of the cooling systems are produced by different specifications in order to fit different diameters of the connecting wires. Therefore, in order to satisfy the market demand of the connecting wires with different diameters, a terminal structure for standard connectors is designed to achieve the requirement of converting various connecting wires.

FIG. 1 shows a schematic diagram of a conventional terminal structure of connecting wires. The conventional terminal structure of connecting wires is disposed on the frame 10 of a cooling system. The frame 10 is hollow and has a motor base 11 on the central portion thereof. A motor stator and a motor rotor are mounted on the motor base 11. Further, the motor base 11 is connected to the frame 10 through a plurality of ribs 12, wherein at least one rib 12 has a wire groove 13 through which the connecting wires of the motor stator extend out to connect to a first connector 21 of the frame 10. The first connector 21 has two connecting pins 211 disposed thereon.

Additionally, the conventional terminal structure further has a second connector 22 that is connected to the connecting wires to be converted. The second connector 22 has two receiving holes 221 in which the connecting pins 211 of the first connector 21 insert and affix. The interconnection and coupling of the connecting pins 211 and the receiving holes 221 between the first connector 21 and the second connector 22 can achieve the objective of electrically connecting and converting various connecting wires.

However, the conventional terminal structure has the following disadvantages:

1. The second connector 22 will unfasten from the first connector 21 easily. The first connector 21 and the second connector 22 interconnect by the coupling of the connecting pins 211 and the receiving holes 221, and are affixed by the friction therebetween. Moreover, the cooling system generates high frequency vibration during operation. Therefore, the second connector 22 will unfasten from the first connector 21 easily.

2. It is difficult to detach the second connector 22. In order to improve the above-mentioned problem, another conventional terminal structure is provided with increasing the friction between the connecting pins 211 and the receiving holes 221, or with other embedded structure (for example, protrusions and grooves). However, in such conventional terminal structure, it is difficult to attach the second connector 22 to the first connector 21, and it is also difficult to detach the second connector 22 from the first connector 21.

Consequently, there is a need for improved connector assembly structure of a terminal to solve the above-mentioned problems that the second connector 22 will unfasten from the first connector 21 easily and it is difficult to detach the second connector 22.

SUMMARY OF THE INVENTION

The main object of the present invention is to provide a connector assembly structure of a terminal used for converting connecting wires, comprising a first connector and a second connector disposed on a frame of a cooling system. The first connector is connected to the connecting wires that are connected to a stator of a motor of the cooling system, and is affixed on the frame. The second connector is connected to the connecting wires to be converted. The electrically interconnection between the first connector and the second connector can satisfy the requirement of converting various connecting wires.

The second connector has at least one hook on the periphery thereof. The cooling system has a releasing hole that corresponds to the hook and can be engaged with the hook. The releasing hole is disposed on the frame and extends through the frame.

As a result, the second connector is secured at a fix position and will not unfasten from the first connector even under high frequency vibration for a long time. On the other hand, the second connector also has an advantage of being detached fast by utilizing the releasing hole. Thus, this invention can satisfy the requirement of converting various connecting wires fast and easily.

DETAILED DESCRIPTION OF THE INVENTION

The present invention is related to a connector assembly structure of a terminal used for converting connecting wires, which is applied on the frames of various cooling systems. Several embodiments for illustrating the relative positions of all elements of the present invention are described as follows.

Figure 1:
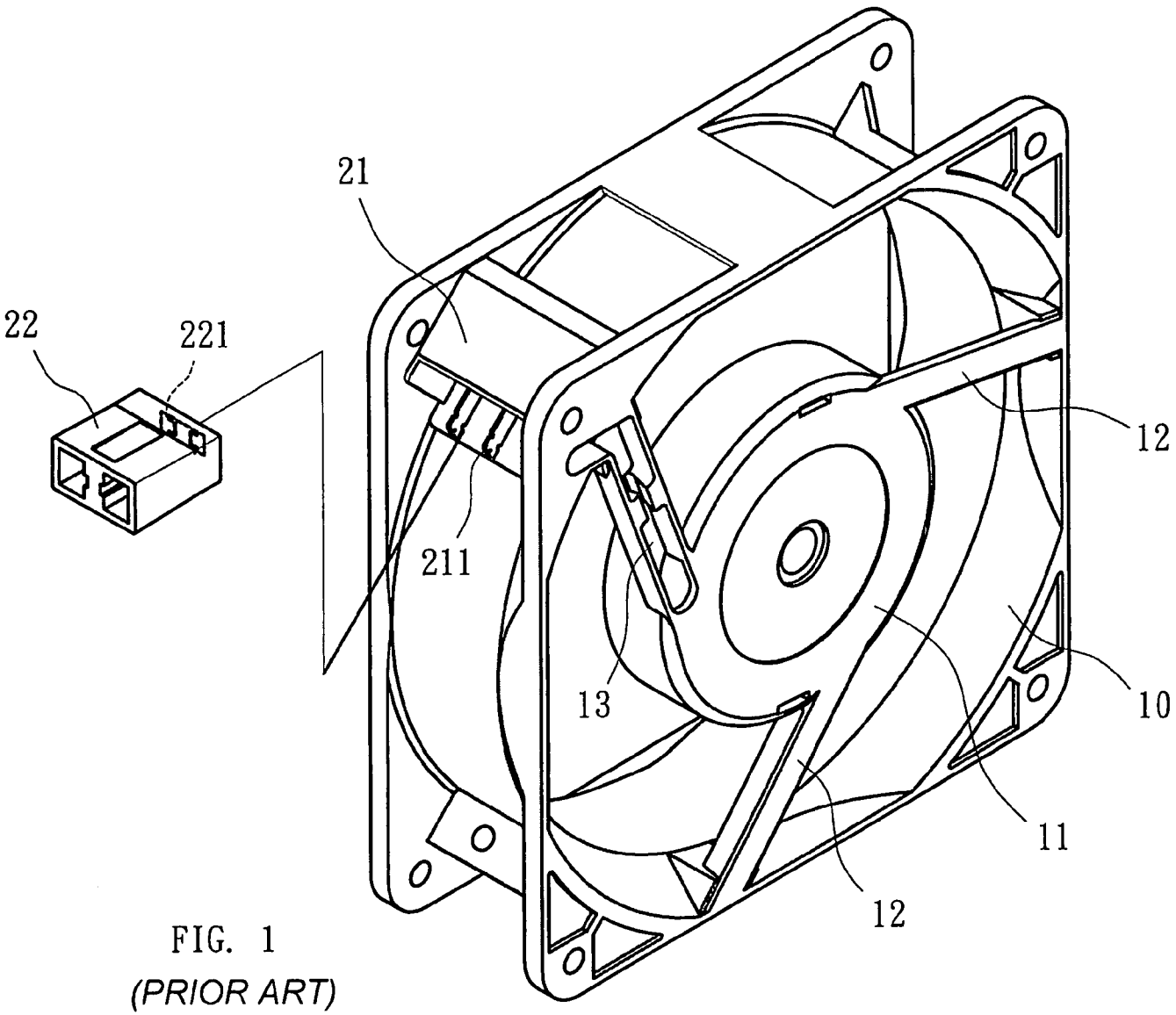
FIG. 1 (PRIOR ART)
FIG. 1 shows a schematic diagram of a conventional terminal structure of connecting wires.
Figure 2:
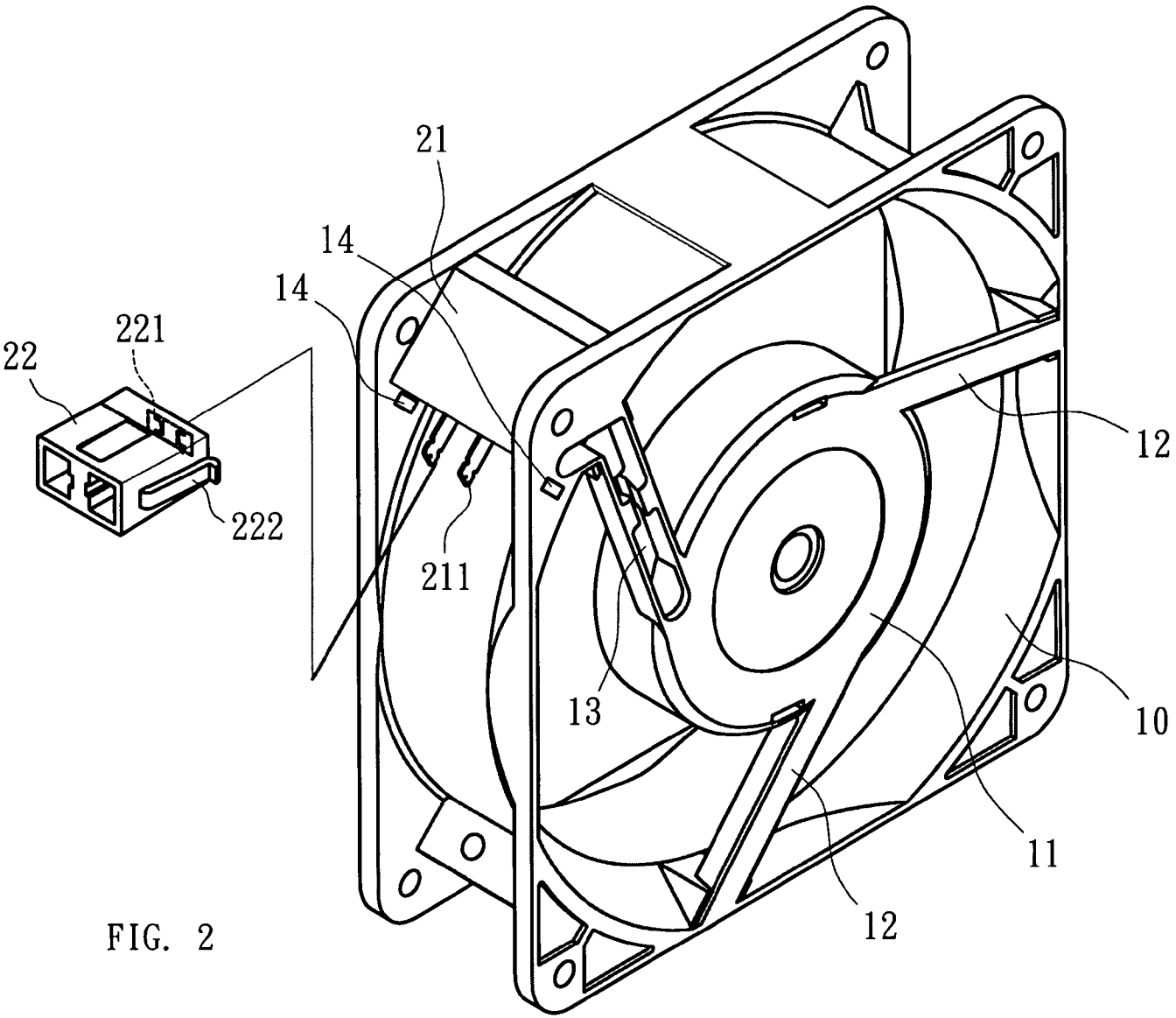
FIG. 2 shows a perspective and exposed view of a terminal structure according to a first embodiment of the present invention.

Referring to FIG. 2, the frame 10 is hollow and has a motor base 11 on the central portion thereof. A motor stator and a motor rotor are mounted on the motor base 11. Further, the motor base 11 is connected to the frame 10 through a plurality of ribs 12, wherein at least one rib 12 has a wire groove 13 through which the connecting wires of the motor stator extend out. A terminal is disposed on the position where the wire groove 13 connects to the frame 10.

Figure 3:
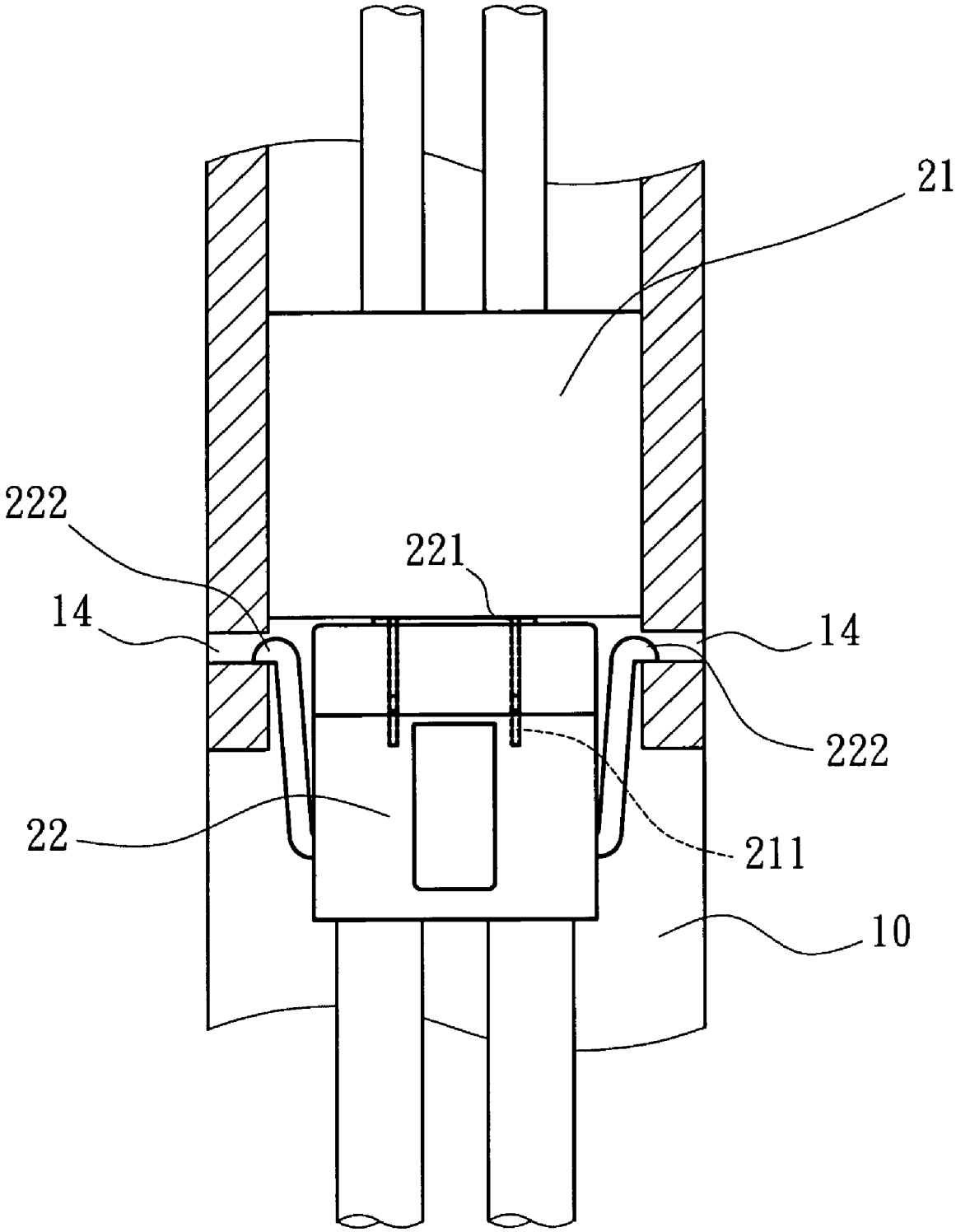
FIG. 3 shows an assembly and cross-sectional view of a terminal structure according to a first embodiment of the present invention.

Referring to FIGS. 2 and 3, the terminal comprises a first connector 21 and a second connector 22. The first connector 21 is connected to the connecting wires that are connected to a stator of a motor, and has two connecting pins 211 on one end thereof. The second connector 22 is connected to the connecting wires to be converted, and has two receiving holes 221 corresponding to the connecting pins 211 of the first connector 21. The interconnection and coupling of the connecting pins 211 and the receiving holes 221 can achieve the objective of electrically connecting and converting various connecting wires.

The first connector 21 is affixed on the frame 10. The second connector 22 has two hooks 222 disposed on the two sides thereof. The frame 10 has two releasing holes 14 that corresponds to the hooks 222 of the second connector 22 and are engaged with the hooks 222. Preferably, the releasing holes 14 extend through the frame 10.

Figure 4:
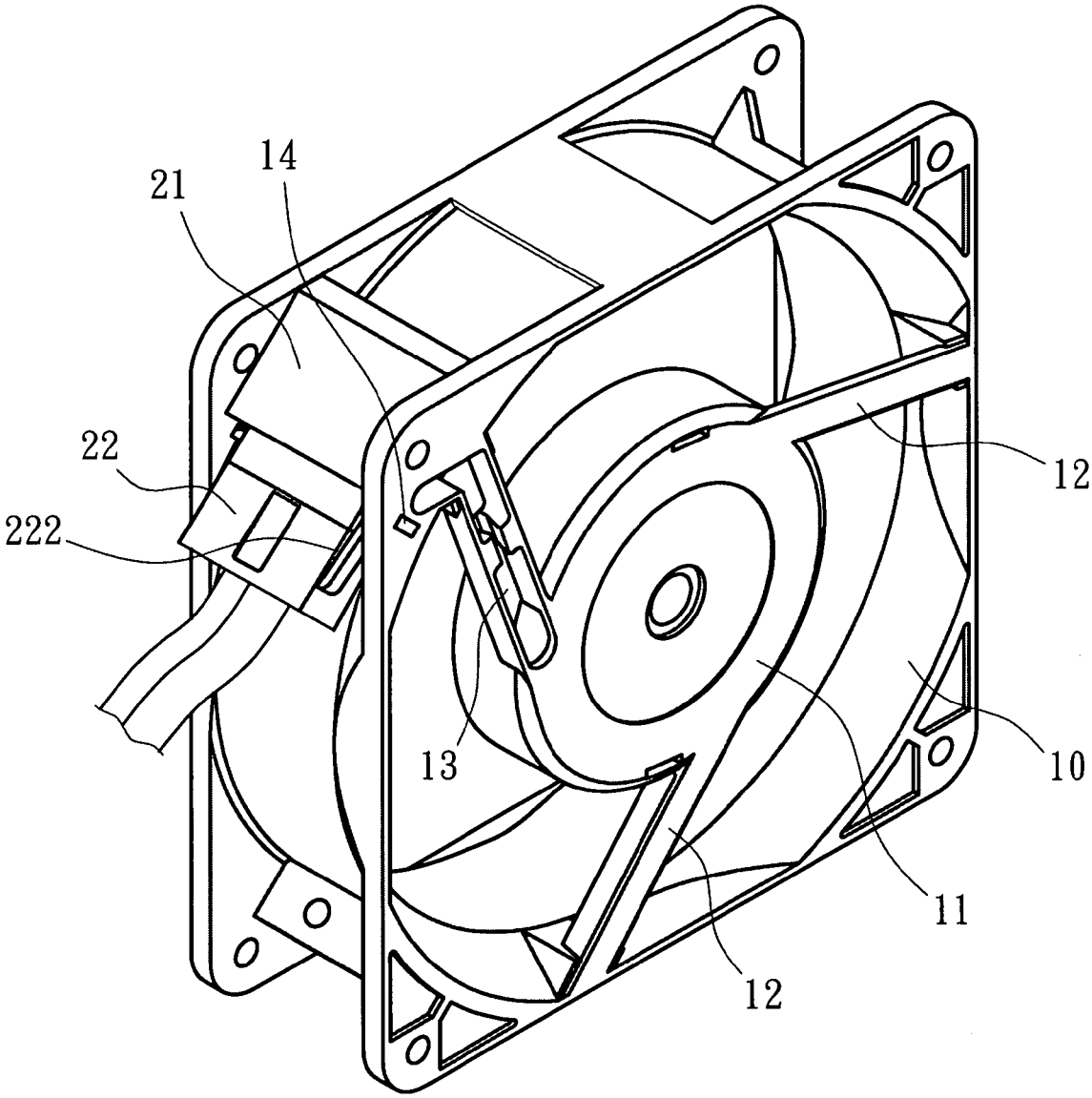
FIG. 4 shows a perspective and assembly view of a terminal structure according to a first embodiment of the present invention.

Referring to FIGS. 3 and 4, to detach the second connector 22, a strip is utilized to urge against the hooks 222 through the releasing holes 14 so that the hooks 222 can unfasten from the releasing holes 14. Thus, the second connector 22 can be removed from the first connector 21.

Figure 5:
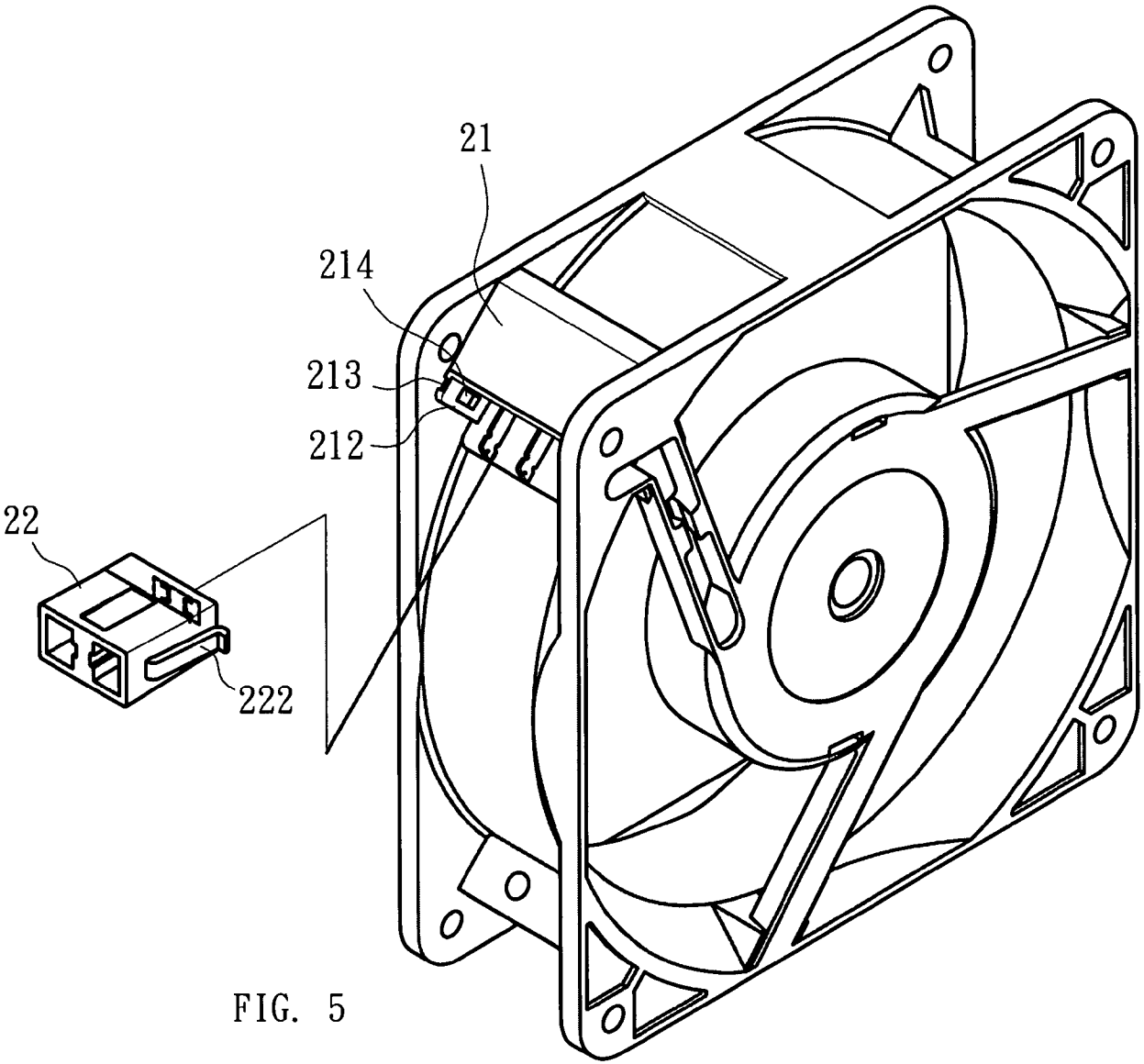
FIG. 5 shows a perspective and exposed view of a terminal structure according to a second embodiment of the present invention.

FIG. 5 shows another embodiment of the releasing holes 214. The releasing holes 14 of FIG. 4 are disposed on the frame 10. Alternatively, the releasing holes 214 of FIG. 5 are disposed on the plates 212 that protrudes from the two sides of first connector 21. In the same way, the releasing holes 214 must correspond to the hooks 222 of the second connector 22 so that it has the functions of being engaged with the hooks 222 and affixing the second connector 22. The plate 212 has a pinhole 213 through which the strip urges against the hook 222 so that the hook 222 can unfasten from the releasing hole 214.

In conclusion, the second connector is secured at a fix position and will not unfasten from the first connector even under high frequency vibration for a long time due to the cooperation of the hooks and the releasing holes according to the present invention. On the other hand, the second connector also has an advantage of being detached fast by utilizing the releasing hole. Accordingly, the disadvantages of the conventional terminal structure are solved thoroughly.

Figure 6:
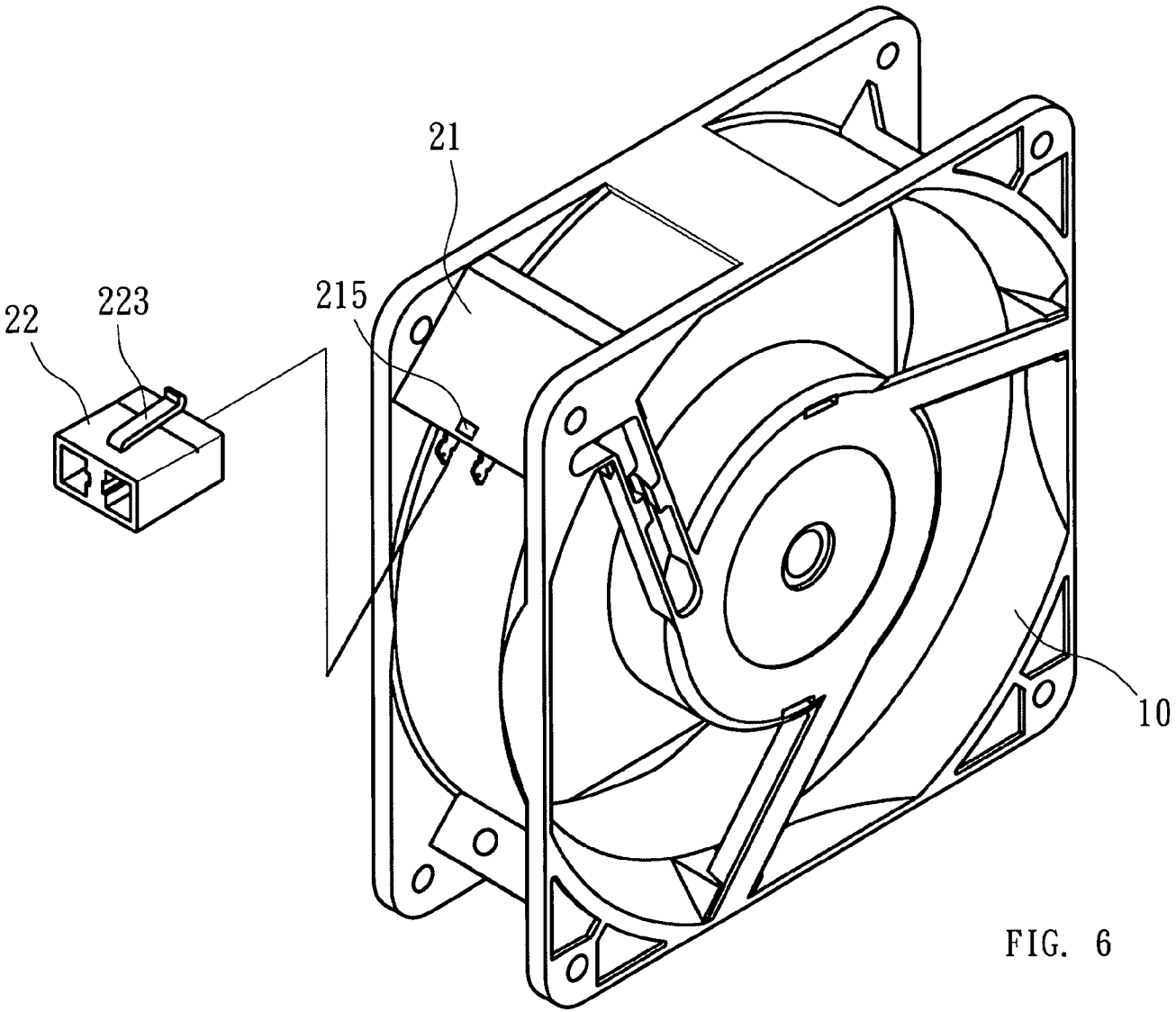
FIG. 6 shows a perspective and exposed view of a terminal structure according to a third embodiment of the present invention.

Additionally, a terminal structure according to a third embodiment of the present invention is shown in FIG. 6. The terminal structure comprises a first connector 21 and a second connector 22. The first connector 21 is affixed on the frame 10. The hook 223 is disposed on the top side with relative large area of the second connector 22. The first connector 21 has a releasing hole 215 that corresponds to the hook 223. In the same way, the embodiment also can achieve the objective of being secured tightly and being detached fast.

From the invention thus described, it will be obvious that this invention as described above is provided for explanation and that the invention may be varied in many ways, where such variations are not to be regarded as departing from the spirit and scope of the invention, and all such modifications as would be obvious to one skilled in the art are intended for inclusion within the scope of the following claims.

What is claimed is:

1. A connector assembly structure of a terminal used for converting connecting wires, comprising a first connector and a second connector disposed on a frame of a cooling system, wherein the first connector is connected to the connecting wires that are connected to a stator of a motor of the cooling system, and is affixed on the frame, the second connector is connected to the connecting wires to be converted, and has at least one hook on the periphery thereof, the cooling system has a releasing hole corresponding to and engaged with the hook;

wherein the frame is hollow and has a motor base on the central portion thereof, a motor stator and a motor rotor are mounted on the motor base, the motor base is connected to the frame through a plurality of ribs, wherein at least one rib has a wire groove through which the connecting wires of the motor stator extend out.

2. The connector assembly structure of a terminal of claim 1, wherein the first connector and the second connector have at least one connecting pin and at least one receiving hole therebetween for coupling and interconnecting.

3. The connector assembly structure of a terminal of claim 1, wherein said at least one hook comprises two hooks disposed on two sides of said second connector.

4. The connector assembly structure of a terminal of claim 3, wherein the releasing hole is disposed on the frame and extends through the frame.

5. The connector assembly structure of a terminal of claim 3, wherein the releasing hole is disposed on the first connector.

6. The connector assembly structure of a terminal of claim 5, wherein the releasing hole is disposed on plates that protrude from two sides of first connector.

7. The connector assembly structure of a terminal of claim 1, wherein the hook is disposed on a top side with relative large area of the second connector.

8. The connector assembly structure of a terminal of claim 7, wherein the releasing hole is disposed on the first connector and corresponds to the hook.

* * * * *